US006792987B2

(12) United States Patent
Monroe

(10) Patent No.: US 6,792,987 B2
(45) Date of Patent: Sep. 21, 2004

(54) AUTOMATIC LABEL SPLICING APPARATUS

(75) Inventor: Richard Monroe, Mashpee, MA (US)

(73) Assignee: PakTech, Inc., Wareham, MA (US)

( * ) Notice: Subject to any disclaimer, the term of this patent is extended or adjusted under 35 U.S.C. 154(b) by 0 days.

(21) Appl. No.: 10/371,487

(22) Filed: Feb. 22, 2003

(65) Prior Publication Data

US 2003/0121593 A1 Jul. 3, 2003

Related U.S. Application Data

(63) Continuation-in-part of application No. 09/611,289, filed on Jul. 6, 2000, now abandoned.

(51) Int. Cl.[7] ..... B35H 19/18; B35H 26/02

(52) U.S. Cl. ..... 156/351; 156/353; 156/361; 156/378; 156/379; 156/504; 242/555.3; 242/555.5

(58) Field of Search ..... 156/361, 367, 156/378, 379, 351, 353, 502, 504, 505, 506, 507; 242/554, 554.1, 554.2, 554.3, 554.4, 554.5, 554.6, 555.3, 555.5, 555.6

(56) References Cited

U.S. PATENT DOCUMENTS 5,624,526 A * 4/1997 Perecman et al. ..... 156/361
5,707,024 A * 1/1998 Mellquist et al. ..... 242/418.1
5,935,361 A * 8/1999 Takahashi et al. ..... 156/159

FOREIGN PATENT DOCUMENTS

GB 2189226 A * 4/1986

* cited by examiner

*Primary Examiner*—Richard Crispino
*Assistant Examiner*—George R. Koch, III
(74) *Attorney, Agent, or Firm*—Thomas H. Karhl, Esq.

(57) ABSTRACT

An automatic splicing apparatus for use in combination with a selected automatic labeling apparatus which uses a sensor and a splicing station through which a first web of stick-on labels passes; a second web of material from a standby roll is held in a ready position for splicing end-to-end with the first web. The first web is stopped and severed at an approximate reference line location, the second web is joined using a splice piece; wherein web feeder continues continuously with uninterrupted operation due to a loose loop located downstream of the splicer permitting splicing the first web to said second web, "on the fly", that is without reducing the speed of the automatic labeling process during splicing.

5 Claims, 9 Drawing Sheets

AUTOMATIC LABEL SPLICING APPARATUS

CROSS-REFERENCE TO RELATED APPLICATION

This application is a continuation-in-part of Ser. No. 09/611,289, entitled Automatic Label Splicing Apparatus filed on Jul. 6, 2000, now abandoned, of Richard Monroe, and which is incorporated herein by reference In the parent application, Ser. No. 09/611,289, entitled Automatic Label Splicing Apparatus, the invention relates to an automatic splicing apparatus for splicing a first web of labels to a second web of labels for use in combination with selected automatic labeling equipment.

In the present application, the invention is clarified as being directed to an automatic splicing apparatus for preparing the trailing end of a depleted roll of labels for splicing to a fresh roll of labels to provide continuous delivery of labels to a selected automatic labeling device. In particular the invention relates to splicing of rolls of labels "on the fly", and providing for error-free labels being applied to the articles being labeled, all without reducing speed of labeling of articles by the associated automatic labeling equipment.

BACKGROUND ART

Labeling apparatus for applying gummed or adhesive-backed labels to packaging arranged on a conveyor arrangement are well known. Typically, such apparatus consist of a supply of adhesive backed labels carried upon a carrier strip comprising an elongate web of release material which is fed from a supply reel to a take-up reel, with a means for applying a label positioned intermediate the two reels. However problems typically arise in making the transition from a the depleted roll to a new roll of labels. These problems are typically addressed by decelerating the operating speed of labeling machines to make the transition from a depleted roll to a fresh roll.

Reference is made to the following U.S. Pat. No. 5,935,361 granted Aug. 10, 1999 to Takahashi et al.; U.S. Pat. No. 5,643,395 granted Jul. 1, 1997 to Hinton, and U.S. Pat. No. 5,039,374 granted Aug. 13, 1991 to Winter.

Referring to U.S. Pat. No. 5,935,361; Takahashi shows a web splicing operation for running and standby rolls that is directed to preparing the leading end of a new web from a new roll of film to obtain positional accuracy of this web in the direction of the width of the new roll after "roll up" of the leading end of the new web. Roll up is provided by an end pullout device that sucks by vacuum means and pulls by roll-up chucks for holding both sides of the pulled out web of the new roll for controlling the web and to prepare a splicing part. By engaging only the sides of the pulled out web, the web is disposed by the roll-up chucks such that there is no scratch on the proximity of the seam of the new web of the new roll. Thereafter the splicing part is sucked by a suction box to await the splicing operation with a depleted roll.

Takahashi does not show web splicing in association with a selected automatic labeling machine, rather features splicing of photosensitive material such as photographic film without scratching in the area of the splice. Furthermore, in order to splice such photosensitive material, Takahashi must employ a roll residual determining device for use with splicing in a darkroom environment.

Referring to U.S. Pat. No. 5,643,395; Hinton shows a label splicing operation which removes the item from a production line when a spliced label is present. Dancer arms are also employed. It appears that these labels are not of the adhesive type that are carried on a web, but rather the labels are printed directly on the web. A controller operates to decelerate the speed of the label application machine to a low speed, e.g. 60 revolutions per minute, for splicing. Typically the controller is employed to ramp down the labeling machine to slower speeds to accomplish a splice, i.e. a controller is programmed to decelerate the speed of the label application machine to a low speed, e.g. 60 revolutions per minute, for splicing.

Referring to U.S. Pat. No. 5,039,374 granted to Winter appears to also operate on a printed web of labels. Here an overlapped splice is used.

A review of the prior art has failed to satisfy the requirements for splicing a depleted roll of labels to a fresh roll, "on the fly", that is without decelerating the speed of operation of an associated labeling machine while providing for error-free labels being applied to the articles being labeled. Accordingly, it is desirable to provide for a new and improved automatic label splicer which uses a sensor and a splice plate arrangement over which a first web of material passes (stick-on labels) for preparing the trailing end of a depleted roll of labels for splicing to a fresh roll of labels to provide continuous delivery of labels to a selected automatic labeling device; which overcomes at least some of the disadvantages of prior art.

SUMMARY OF THE INVENTION

The present invention is directed to an automatic splicing apparatus comprising a splicing station for splicing a first web of labels to a second web of labels for use in combination with a selected downstream labeling apparatus which in turn affixes labels to selected goods. A dual unwind mechanism is employed in combination with the splicing station for initially unwinding a first roll of labels responsive to drive means and holding the second roll of labels in standby, and then as this first roll unwinds and becomes depleted, splicing it to the second roll. The splicing station comprises a moveable lower splice plate, a moveable cutter back plate 5, cutter assembly and a fixed upper lower splice plat. Loop control apparatus is included in the automatic splicing apparatus for controlling the size of loops of running web maintained by said splicing apparatus for accumulating labels to maintain continuous labeling during a splicing operation. In particular the loop control apparatus maintains a constant loop in the web of labels, in a accumulator or "loop box", as the running web of labels is drawn past the splicing station by a pull nip driven by a drive motor. When the running web is depleted and is stopped and clamped by the cutter back plate, during a splicing operation in the splicing station, the labels contained in the loop box continue to be available to be drawn downstream by the labeling machine to provide for splicing "on the fly", that is, without reducing the speed of the automatic labeling process during splicing.

In preparation for splicing a standby web of labels to a depleted running web of labels, the lead end of the standby roll is pulled out manually, divisions between labels is identified, the lead end is then severed at a division between adjacent labels, the severed lead end of the standby roll, the splice is then manually positioned in alignment with a splice reference line marked on the lower splice plate. Once the splice is positioned on the lower splice plate, it is held in place by suction applied by a on board vacuum pump which evacuates are through holes in the base of said lower splice plate acting to hold the splice piece in place. The lower splice plate is moveable responsive to operation of a splice cylinder, between a spaced apart, standby position and a splice position wherein it is compressed against the upper splice plate by said splice cylinder. The splice on the lead end of the standby roll is then held in a standby mode on said lower splice plate awaiting a splicing with the trailing end of a depleted running web of labels.

In the present invention, registration means is employed for putting labels on the running web in registration with labels on the standby web during splicing. Registration is accomplished by means of a splice controller including a shift register counter for controlling the speed of drive means for putting the web of the first roll in registration with the second roll. The controller also includes sensing means for locating the division between labels register means for controlling the splice sequence.

The initial phase of the splice sequence of the splice station involves pivoting the cutter back plate between a first retracted position to a second cutting position. Said splice controller thereafter activates a cutter actuator for moving the cutter between a first position, for severing the running web at a point between adjacent labels for preparing a splice piece, and a second retracted cutter position. The splice piece of the running web is held in place on the air register of the upper splice plate. In the next sequence, the cutter back plate swings back from the cutting position to a home position, the lower splice plate indexes up between a first standby position to a second compression position with the splice piece of the standby web in registration with the splice piece of the running web. In this compression position the splice piece of the standby web is compressed against the splice piece of the running web held against the upper splice plate. Thereafter the lower splice plate retracts to the non compression mode wherein control of web speed is shifted back to the photocell sensing means and the turret is rotated such that the new running roll is on top a new roll is placed on the bottom. Thereafter the next successive splice is manually prepared and placed on the lower splice plate where it is held by vacuum created by a vacuum pump connected to orifices provided in the lower splice plate.

In the present invention, splicing occurs when the first web is stopped and severed at a selected reference line location, whereupon the second web is joined to the first web employing using a splice piece to join the severed trailing end of the first web which has been depleted, to the leading end of a fresh roll held in standby. During the process of splicing of said severed ends together, labels are continuously fed to the automatic labeling equipment with uninterrupted operation due to a loose loop in the first running web located between the labeling equipment and splice plate arrangement, downstream of the splice plate assembly. In order to provide fully automatic splicing of rolls of pressure sensitive labels a dual unwind is employed by the splicing apparatus comprising a first running roll comprising a web of labels on top and a second standby roll comprising a web of labels on the bottom. is employed having the ability to splice on the fly at a rate comparable to or exceeding most automatic labeling equipment The splicing apparatus is activated by drive means for unwinding the running roll and maintaining a constant loop of labels in a loop box. Also included is loop sensing means comprising a photoelectric cell for monitoring and controlling the size of the loop means for delivering a constant supply of labels.

In the splicing station of present invention there is mounted above the running web having divisions between adjacent labels, an web label cutter for making a splice cut in the trailing end of the depleted running web. After the web is cut, the trailing end is held on the upper splice plate, mounted on a fan housing, wherein the fan draws air through said upper splice plate to hold said terminal end of the web on the upper splice plate, in registration with the lower splice plate. The controller comprises sensing means comprising a photoelectric cell for detecting the shaft of the turret which is only visible at terminus of the web of the running roll which triggers the splice sequence.

The present invention typically is employed to handle a web comprising pressure sensitive labels, but can also accommodate a web comprising continuous labels as well as a web of continuous unprinted labels. Accordingly, for the purposes of this invention, the term web comprises pressure sensitive individual labels on a continuous carrier made of, but not limited to, paper or plastic film. Registration according to the present invention is accomplished by detecting the division between the labels or accomplished by detecting the divisions between the labels or any other means of monitoring a register position of the web.

In the present invention the splicing of the depleted roll to the fresh roll does not produce any 'bad' labels being applied to an article by the downstream automatic labeler. This is a major savings to the user, i.e. he has no waste of product or label, no cost of tracking and reject system and possible fines for a bad label if it got through on an article in some industries, such as food and consumer.

Accordingly it is an object of the present invention to provide in an automatic splicing apparatus for the preparation of the trailing end of a depleted roll of labels for splicing to a fresh roll of labels whereby continuous delivery of labels is provided to a selected automatic labeling device.

Another object is to provide splicing of a depleted roll of labels to a fresh roll of labels of labels "on the fly", and providing for error-free labels adjacent the splice being applied to the articles being labeled, all without reducing speed of labeling of the associated automatic labeling equipment.

The invention will be described for the purposes of illustration only in connection with certain embodiments; however, it is recognized that those persons skilled in the art may make various changes, modifications, improvements and additions on the illustrated embodiments all without departing from the spirit and scope of the invention.

DETAILED DESCRIPTION OF THE PREFERRED EMBODIMENT

Figure 1:
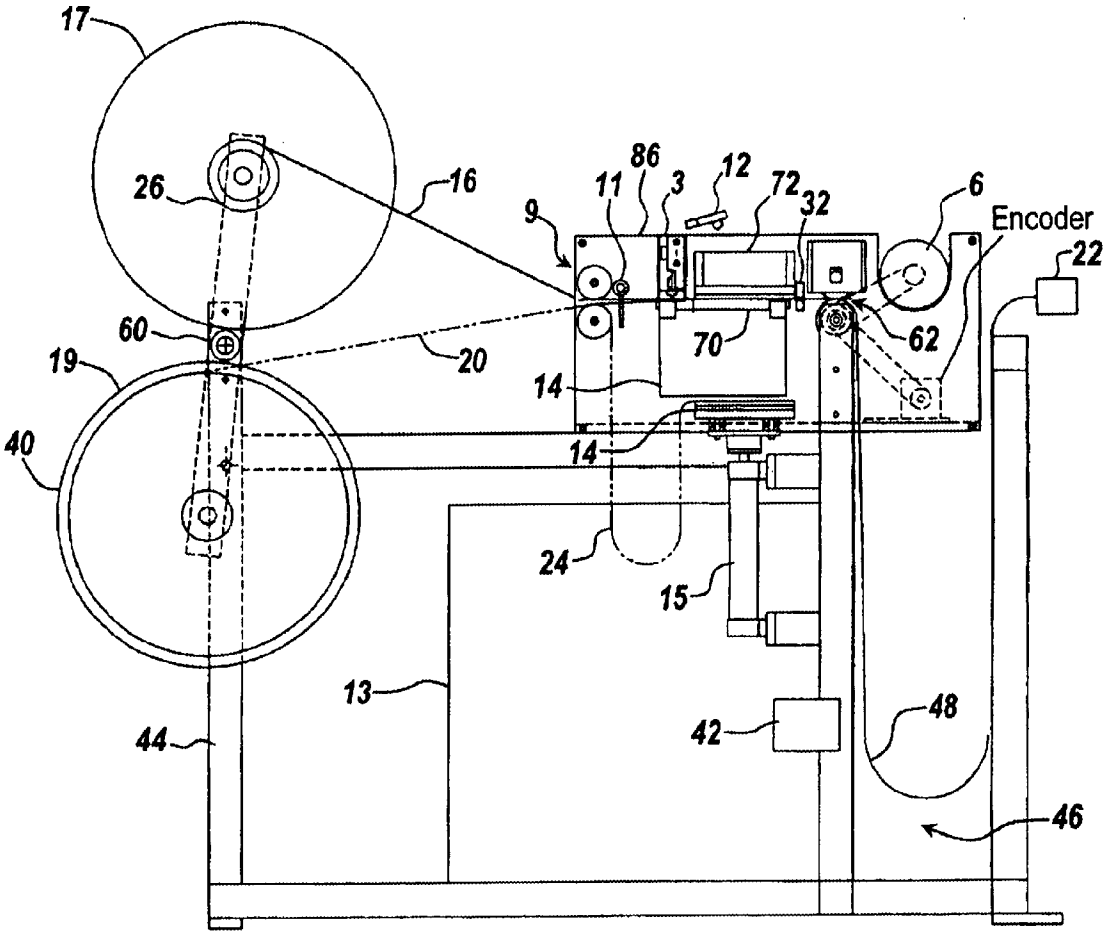
FIG. 1 is a front elevational view of the automatic label splicing apparatus of the present invention shown in the auto splice ready position.
Figure 2:
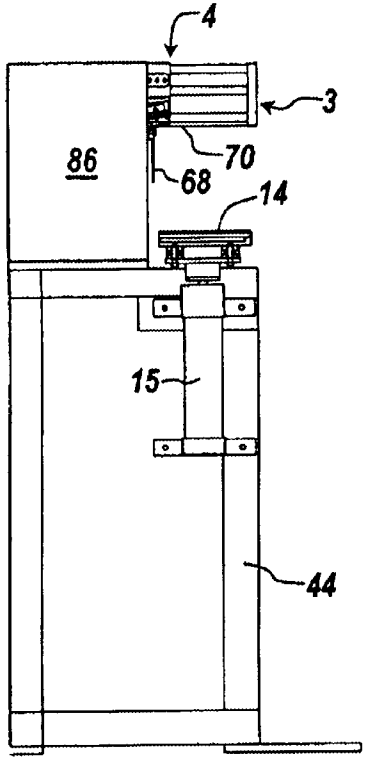
FIG. 2 is a side elevational view of the splicing station taken along lines 2—2 of the present invention shown in FIG. 1, shown in the auto splice ready position.
Figure 3:
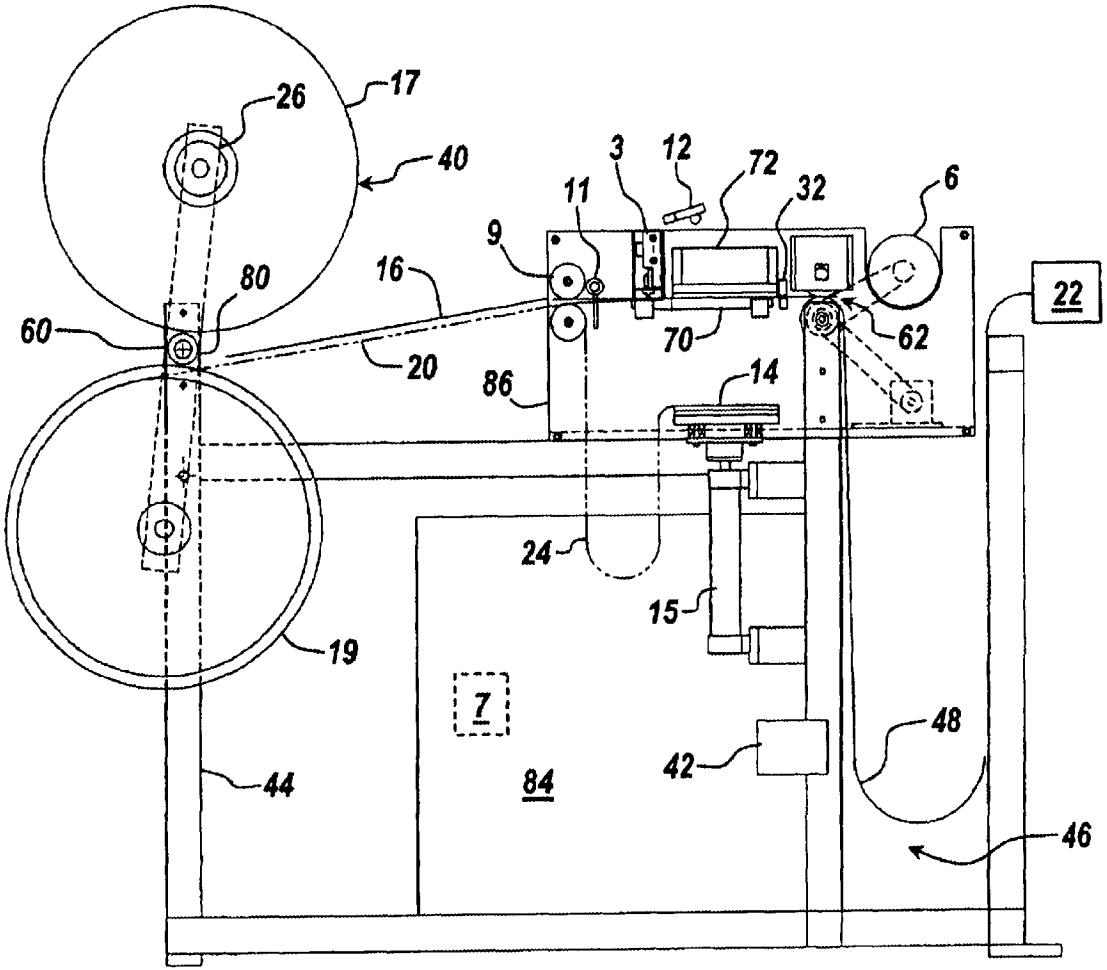
FIG. 3 is a view of the invention shown in FIG. 1 shown in the auto splice cut position.
Figure 7:
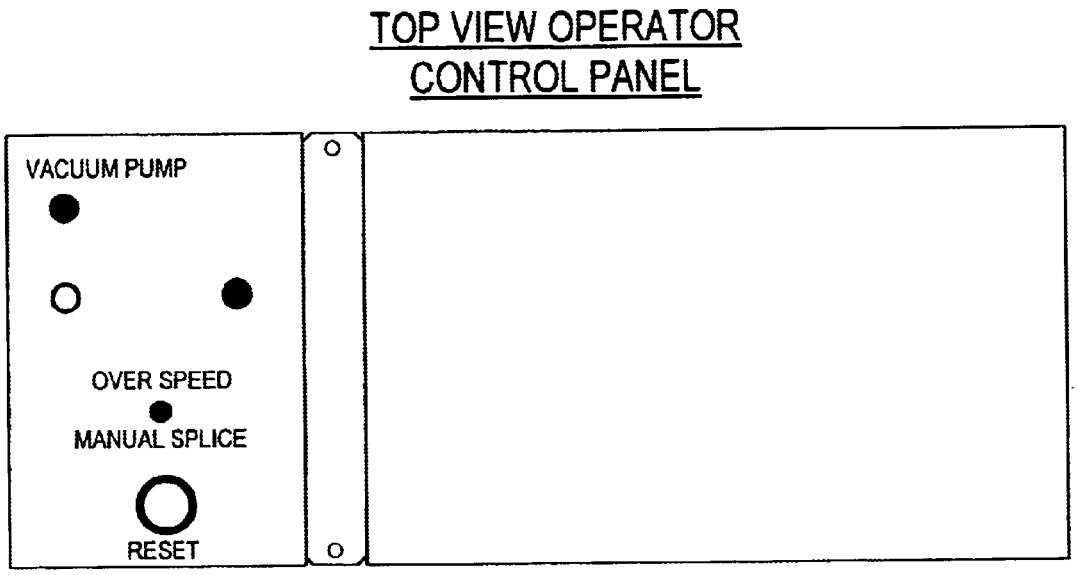
FIG. 7 is an enlarged view of the control box of the splice station shown in FIG. 1 including a splice controller including a shift register counter for controlling the speed of drive means for putting the web of the first roll in registration with the second roll.
Figure 8:
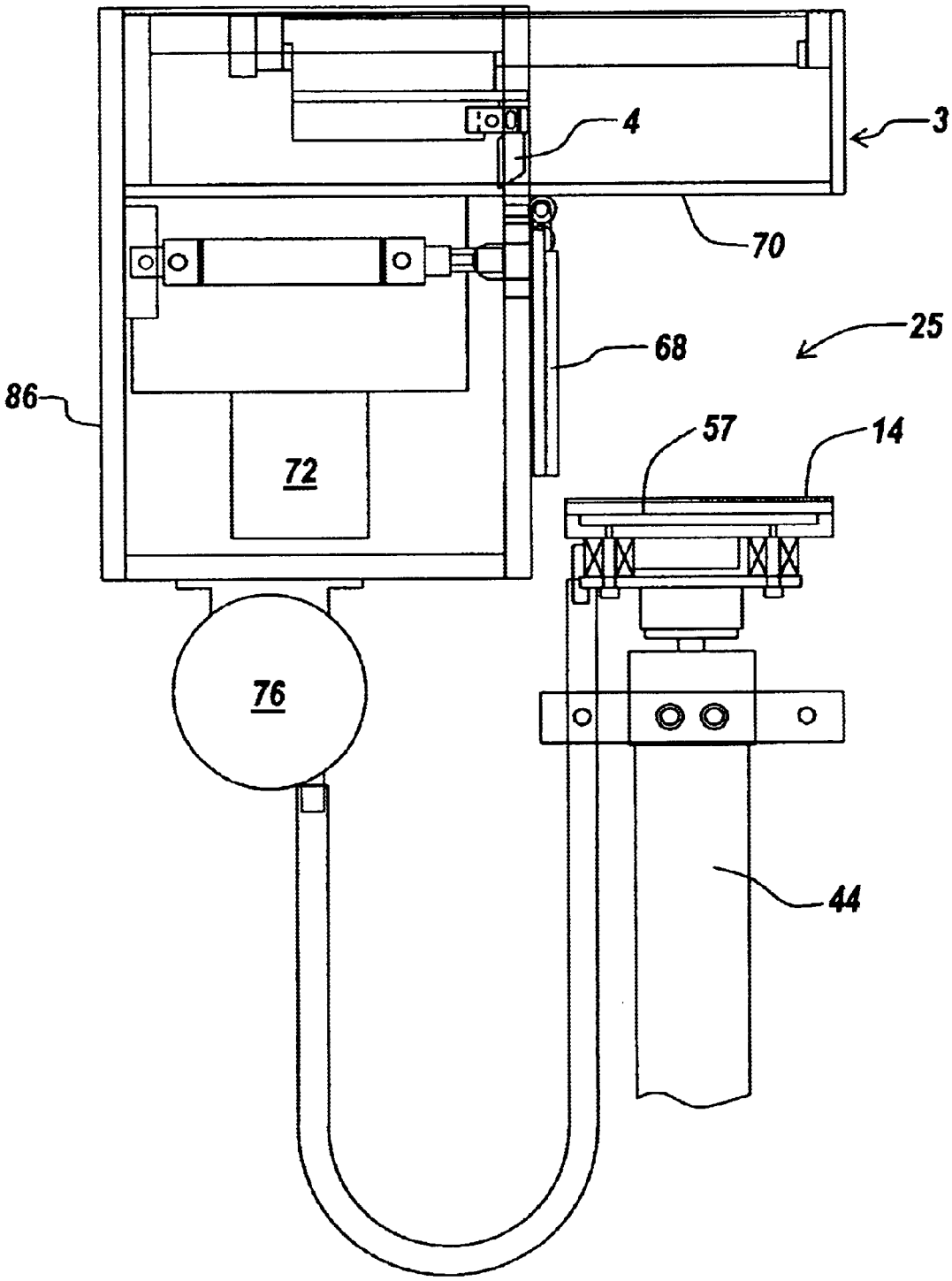
FIG. 8 is an enlarged view of splice station shown in FIG. 2 shown in the auto splice ready position.
Figure 9:
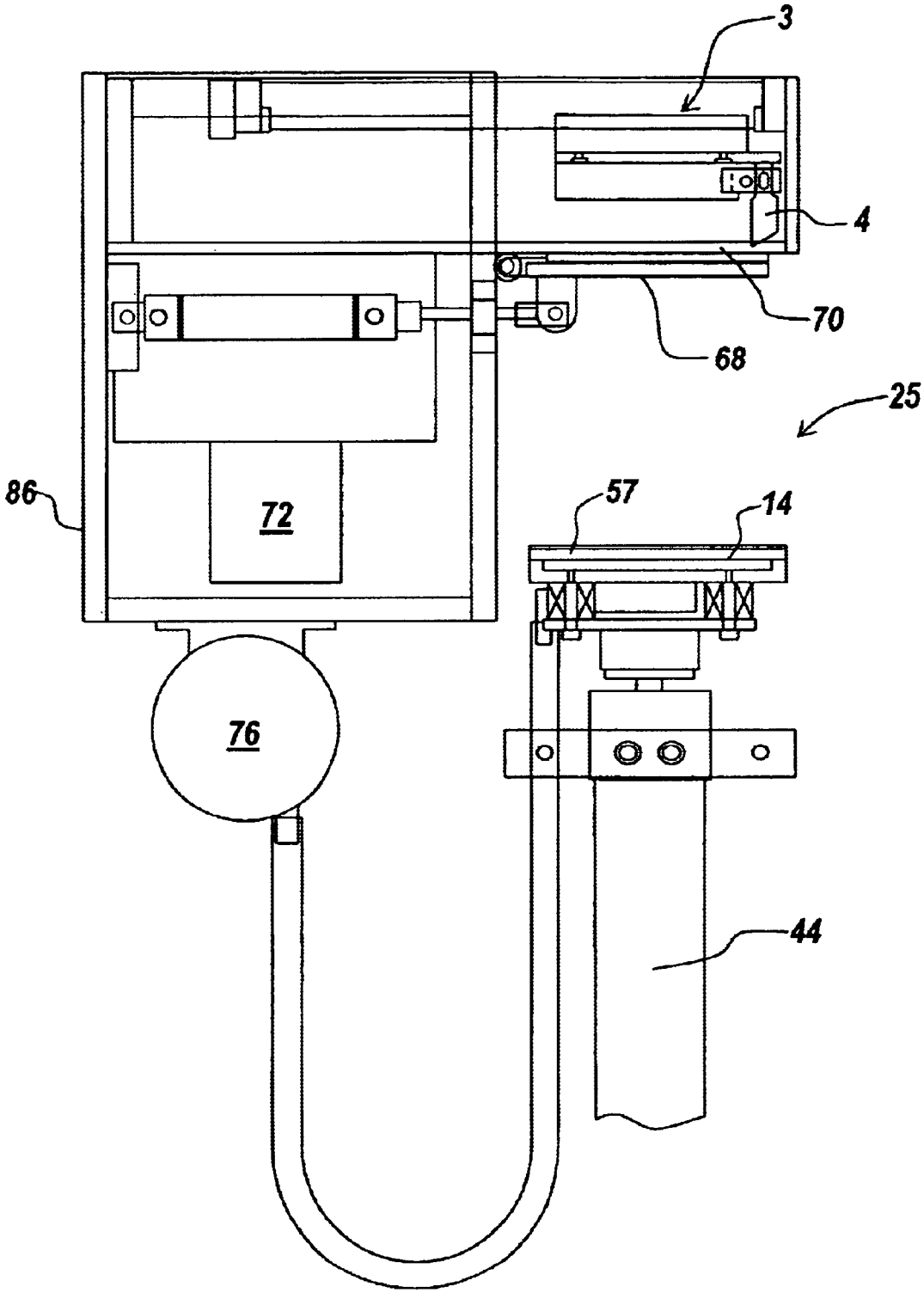
FIG. 9 is an enlarged view of splice station shown in FIG. 2 shown in the auto splice cut position.

Referring to the FIGS. 1–9, there is shown the preferred embodiment of the automatic label splicer 10 including of splice station 25, having a dual unwind shown as 40 in FIG. 1, positioned upstream of splice station 25, and a selected automatic labeling apparatus 22, downstream of said splice station 25. Referring to FIGS. 7–9, splice station 25 includes an upper splice plate 70, a cutter assembly 3, a moveable cutter back plate 5, and a moveable lower splice plate 14. As shown in FIGS. 1–3 a photoelectric, end-of-roll sensor 12 cooperates with upper splice plate 70 under which a first web 16 of material from a running roll of labels 17, passes. The splice station 25 is capable of fully automatic splicing of a first roll 17 of pressure sensitive labels 18 mounted on said dual unwind 40 to a second roll 19, also on mounted said dual unwind 40.

Referring to FIGS. 6A through 6D, the labels 18 are configured as pressure sensitive, are mounted on a web 16 with divisions 21 between adjacent labels 18, wherein said automatic label splicer 10 has the ability to splice said labels on the fly at a rate comparable to a selected automatic labeling equipment 22, see FIG. 1.

In the preferred embodiment the dual unwind 40 comprises turret 26 operable between a first and second position. In the first position shown in FIG. 1, first running roll 17 comprising a running web of labels 16 is on top, and a second standby roll 19 comprising a standby web of labels 20 is on the bottom. Referring to FIG. 1, automatic label splicer 10 is activated by drive motor 6, having an associated brake 1, for unwinding the first running roll 17 for supplying a web of labels 16 to automatic labeling equipment 22 and maintaining a constant output loop 48 of labels 18 in a loop box 46. As is shown in FIG. 2, a sensing means comprising a photoelectric operated loop detector 42 is positioned on frame member 44 for monitoring and controlling the size of output loop 48 by regulating drive motor 6 and associated brake 1, for delivering a constant supply of labels to a downstream automatic labeling apparatus shown as 22 in FIG. 1.

Figure 10:
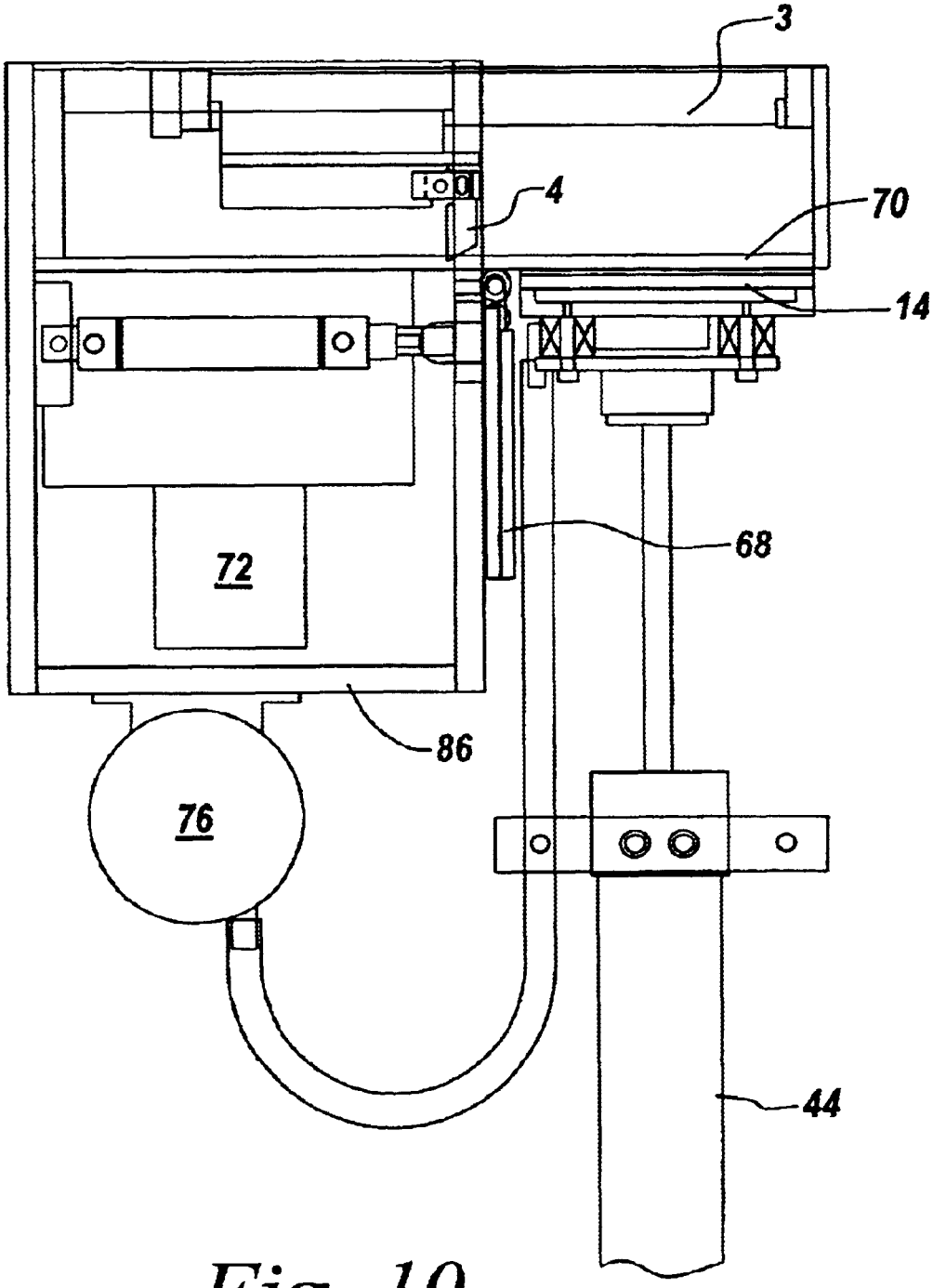
FIG. 10 is an enlarged view of splice station shown in FIG. 2 shown in the auto splice-splice position.

Referring to FIGS. 1, 7–10, cutter assembly 3 is arranged for making a splice cut 52 in the trailing end 58 of the web 16 positioned on running roll 17. Lower splice plate 14 includes a vacuum positioning device 56 comprising a pad 57 having a plurality of orifices 55 in communication with an on board vacuum pump 59, for drawing air through said pad 57 and holding leading end 54 of the web 20. As is shown in FIG. 3, end of roll sensor 12, comprising a photoelectric cell, is mounted on frame 44 aligned for detecting the reflector 80 positioned on shaft member 60 of the turret 26, which is only visible at terminus of web 16 of the running roll 17, as is shown in FIG. 3. Having detected shaft member, end of roll sensor 12 initiates a splice sequence shown in FIGS. 8, 9, & 10. Referring to FIGS. 8–10, splice station 25 includes an upper splice plate 70, a cutter assembly 3, moveable cutter back plate 5, and a moveable lower splice plate 14. As shown in FIG. 3, end-of-roll sensor 12 cooperates with upper splice plate 70 under which a first web 16 of material from a running roll of labels 17, passes. As is shown in FIGS. 6A–6D, said web 16 includes stick-on labels 18 positioned in spaced apart longitudinal relation, separated by divisions 21.

As is shown in FIG. 1, second web of material 20 having labels 18, mounted on standby roll 19, is held in a ready position on lower splice plate 14 for splicing end-to-end with the first web 16 as it becomes depleted, as shown in FIG. 3. Upon depletion, as indicated by roll sensor 12 detecting shaft member 60 of the turret 26, said web 16 is stopped by end-of-roll sensor 12 and severed by cutter 4 at an cutter slot 5 shown in FIG. 11. The second web 20 is joined to first web 16 using a splice piece 30 shown in FIG. 6C. During the splice sequence, web feeding of labels 18 continues to downstream automatic labeling equipment 22, with uninterrupted operation due to labels stored in a constant output loop 48 shown at FIGS. 1–3 located downstream of the automatic splicer 10.

Referring to FIG. 1, drive motor 6, typically a variable speed motor, drives a rubber pull nip 62, comprising anti-static conductive rubber, that engages running web 16 to unwind running roll 17, having a 20 inch size, by pulling said web 16 over and past. During labeling operation said rubber pull nip 62, pulls said web 16 from running roll 17, at a speed determined by the selected labeling machine 22, over guide roller 51, through product guides 11, and below cutter assembly 3, such that said web 16 passes beneath upper splice plate 70 mounted stationary on fan housing 86. Thereafter web 16 is pulled over rubber pull nip 62 by drive motor 6, hence through "Loop Box" 46, and thereafter passes downstream to said automatic labeling machine 22.

A substantially constant loop, i.e.; varying no more than 10% in length, of labels 18 is maintained in the accumulation or "Loop Box" shown at 46 in FIG. 1. This is accomplished by means of the following; an output loop detector 42 (photocell) monitors the bottom of the output loop 48 and turns motor 6 off when loop 48 is at full length, i.e. extending the full length of or "Loop Box" as is shown in FIG. 1; and turns motor 6 on when loop 48 is at 10% of full length. This permits a constant supply of labels 18 to be delivered to the labeler 50 at a preset rate as dictated by said labeler. The "accumulation" of labels in the "Loop Box" 46 provides for labels 18 to continue to be delivered while running web 16 is kept tight to the bottom of upper splice plate 70 thereby insuring that the speed of the automatic labeling machine does not exhaust the supply of labels or require the speed of labeling to be reduced. Web 16 is kept tight to upper splice plate 70 by the action of fan 72 to keep said trailing end of running web 16 in registration with the lower splice plate 14 awaiting splicing. The upper roll is the running roll 17 on which is mounted running web 16 and the bottom roll is the standby roll 19 on which is mounted standby web 20.

Referring to FIG. 3, running web 16 is normally supported in a horizontal plane between guide roller 51 and pull nip 62, and passes beneath upper splice plate 70 that is mounted on the bottom of fan housing 86. As is shown in FIG. 10 upper splice plate 70 is provided with a plurality of orifices comprising air register 88, which orifices are in communication with fan 72 mounted within fan housing 86. Ducting for the air drawn by said fan 72 is provided by fan housing 86. Referring to FIG. 9, during the splicing sequence following cutting the trailing end 43 of running web 16 as set forth below, wherein running web 16 is kept tight to the bottom of upper splice plate 70 to keep said trailing end of running web 16 in registration directly above splice 74 being held on lower splice plate 14 with the awaiting splice held on lower splice plate 14 also kept tight by communication with fan 72 is kept tight to the top of lower splice plate the aid of a fan 72 drawing air through orifices provided by air register 88

The splice 74 is prepared on the lead end 54 of the standby roll web 20, see FIGS. 6A–6D, and placed on the lower splice plate 14, being positioned abutting reference line mark 38, positioned in coplanar relationship with cutter groove 41, where it is held in place with the on board vacuum pump 56 shown in FIGS. 9 & 10. The unit is now ready for a splice.

As is shown in FIG. 2, at the end of the running roll 17, the label web 16 will pull away from the core 64, allowing the photocell, end of roll sensor 12 to see the reflector 80 on the center shaft 60 of the turret 26. When the end of roll sensor 12 sees reflector 80, the controller 7 of motor 6 goes into creep speed, looking for the division 21 between labels 18 in the area of web located at the trailing portion of the labels 18, spaced from the from the cutter 4. When the division 21 is seen, drive motor 6 will advance a predetermined number of steps set into the shift register counter 84. Reference is made that at the time of initial start of a run of labeling, the registration of splicer with labeler is calibrated. Thereafter, the motor 6 will stop, the trailing end 58 of web 16 will stop, the action of the labeling apparatus continues to pull the portion of running web 16 accumulated in "lop box" 46 continues to provide labels 18 to be delivered, thereby insuring that the automatic labeling machine does not exhaust the supply of labels or require the speed of labeling to be reduced.

Splice Sequence

Referring to FIGS. 1, 2 & 8, the splice station is shown in the auto splice ready position with the lower splice plate in the lower, splice ready position.

Referring to FIGS. 3 & 9, the splice station is shown in the auto splice-cut position; shown with the moveable blade of the cutter assembly in the cut position.

Figure 4:
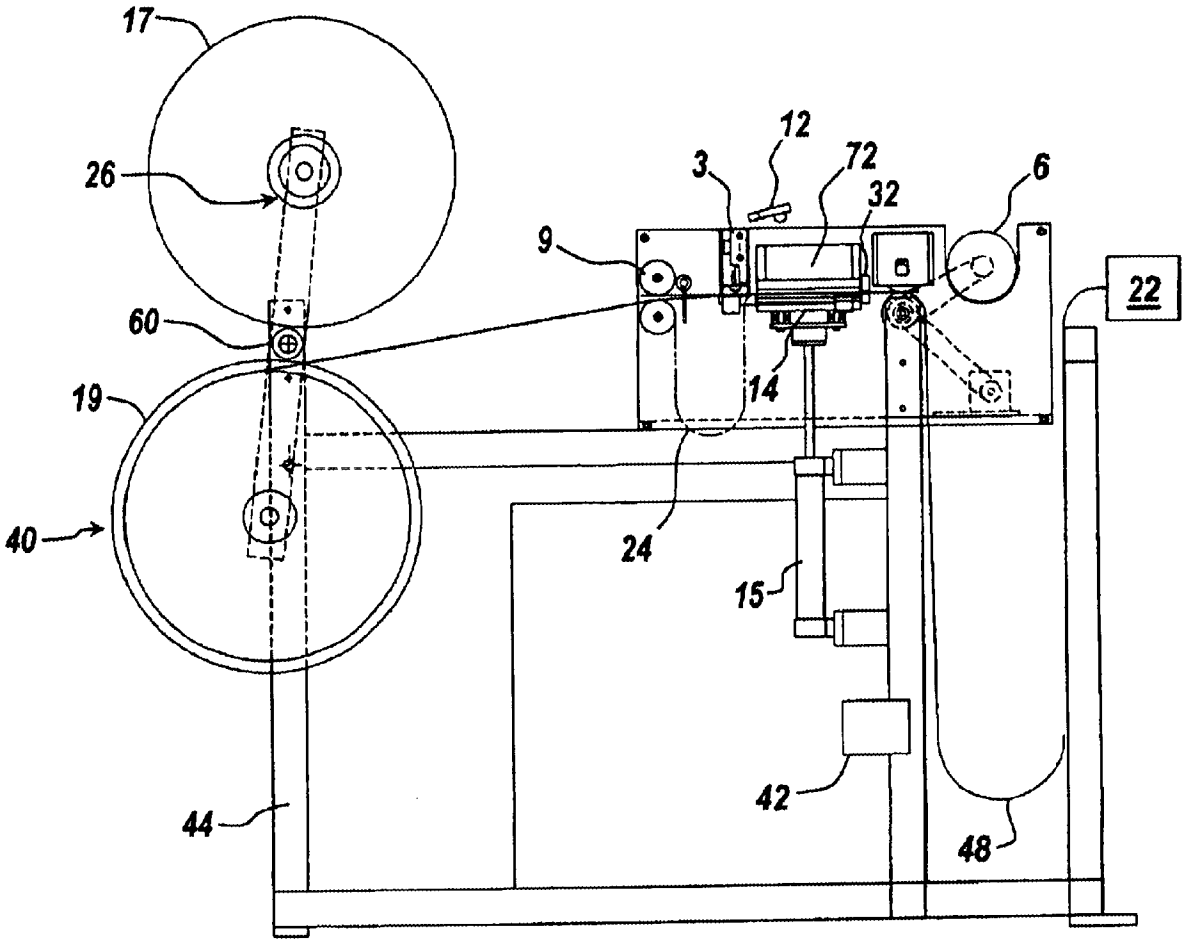
FIG. 4 is a invention shown in FIG. 1 in the auto splice-splice position.
Figure 5:
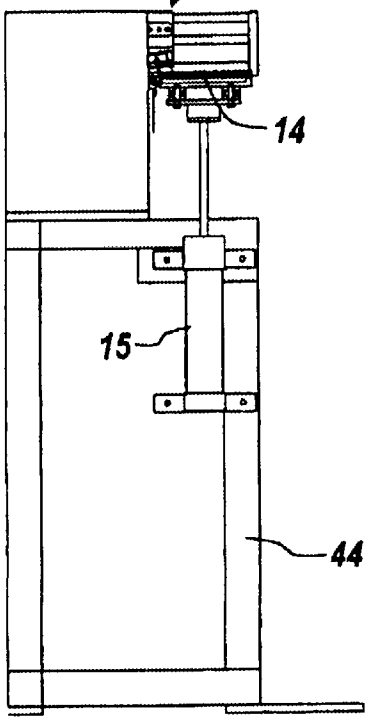
FIG. 5 is a side elevational view of the splicing station taken along lines 2—2 of the present invention shown in FIG. 4, shown in the auto splice—splice position.
Figure 6A:
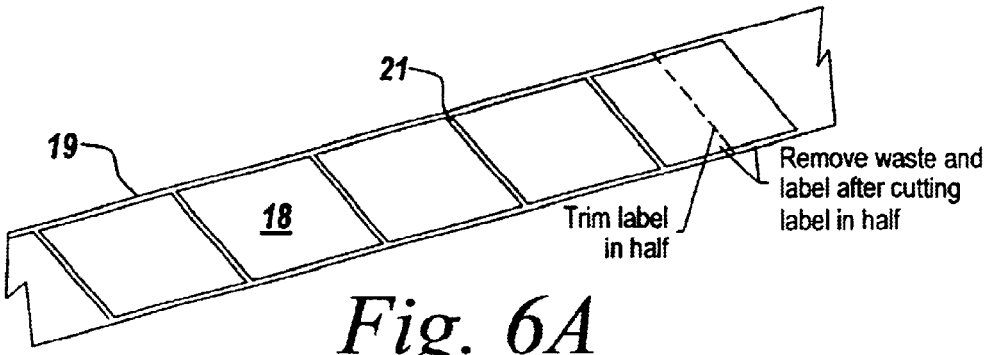
FIG. 6, composed of parts 6A to 6D, is a schematic representation of the splicing of the leading and trailing ends of the respective standby and running webs associated with the vacuum pad of the lower splice plate.
Figure 6B:
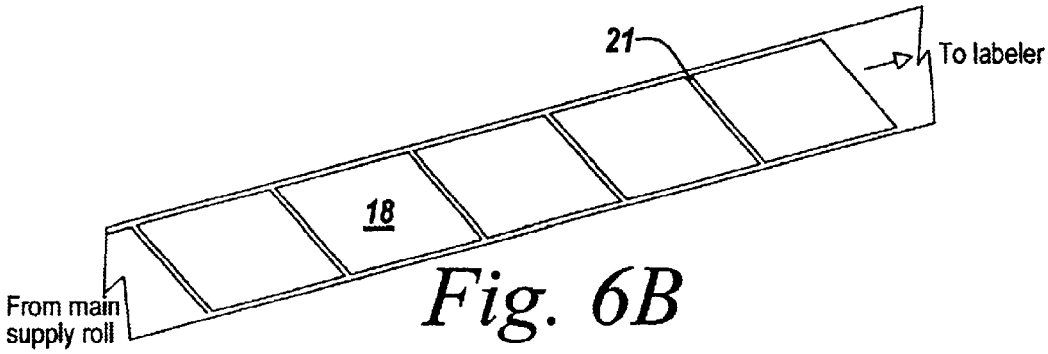
Figure 6C:
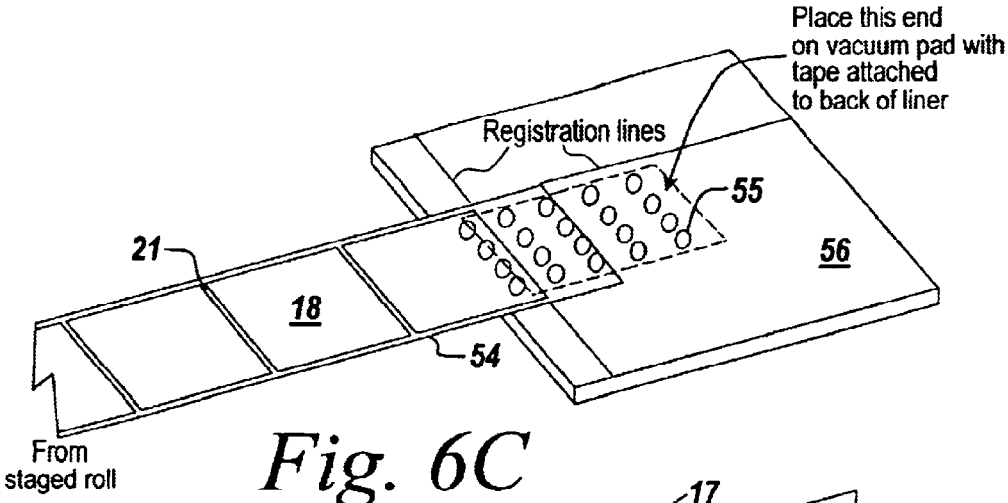
Figure 6D:
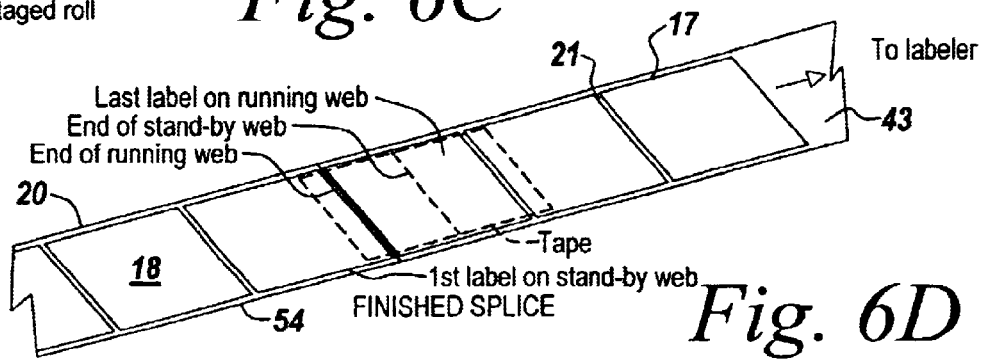

Referring to FIGS. 4, 5 & 10, the splice station is shown in the auto splice-splice position; shown with the lower splice plate in the upper splice position.

Operation of the Splice Sequence Commences as Follows:

(1) Rubber coated cutter back plate 68 will swing up trapping the running web 16 against the upper splice plate 70 with label division 21 in registration with cutter slot 5 provided in said upper splice plate 70 oriented in orthogonal relationship with said running web 16. The cutter assembly 93 comprising cutter 90 mounted on said cutter slot 5, in communication with cutter actuator 95.

(2) Cutter 90 is actuated by cutter actuator 95, to extend along cutter slot 5 severing the running web 16 at the division 21 between labels situated above cutter slot 5.

(3) Cutter 90 retracts and the cutter back plate 68 swings back to the "home" position at the same time running web 16 is kept tight to the bottom of upper splice plate 70 by fan 72 to keep said trailing end 43 of running web 16 in registration directly above reference line mark 38 on lower splice 74

(4) Lower splice plate 14, with the prepared splice 12 shown in FIGS. 9 & 10 sequentially indexes up responsive to splice cylinder 15 against running web 16 held tight to the bottom of upper splice plate 70 by fan 72 located in fan housing 86 such that said trailing end 43 of running web 16 is kept in registration directly above lower splice 74 held on lower splice plate 14; compressing the two webs 16 & 20 together with terminal division 21 of web 16 superimposed over initial division 21 of standby web 19 for splicing as is shown in FIG. 10

(5) The lower splice plate 14 retracts, and the web control is shifted and returned to the photocell 42 on the loose loop box 46.

An operator then turns the turret 26 so the running roll 17 is on top, and a new roll 19 is placed on the bottom position. The next splice is manually prepared and placed on the lower splice plate 14 where it will be held with the on board vacuum pump 59. At this point the door 64 should be closed to turn on the air supplied by on board vacuum pump 59 and the reset button 34 on the top must be pushed to arm the start cell 36

Registration for Error Free Labels

In the preferred embodiment splice preparation insures that each "good" splice includes the following steps;

a) registration of the lower splice plate with the cutter slot of the cutter assembly by locating a splice reference line on the top of the lower splice plate coplanar with the plane of travel of the cutting blade;

b) registration of the lead end of the standby web with the splice reference line on the holding surface of the lower splice plate c) putting the divisions between labels on the trailing end portion of the running web in registration with the plane of travel of the cutting blade;

d) holding the trailing end portion of the running web against the holding surface of the upper splice plate by air suction of on vacuum pump to insure that registration is maintained during splicing e) there being an overlap of standby web and running web produced in the splicing procedure for added strength.

Method of Operation of Controls

Figure 11:
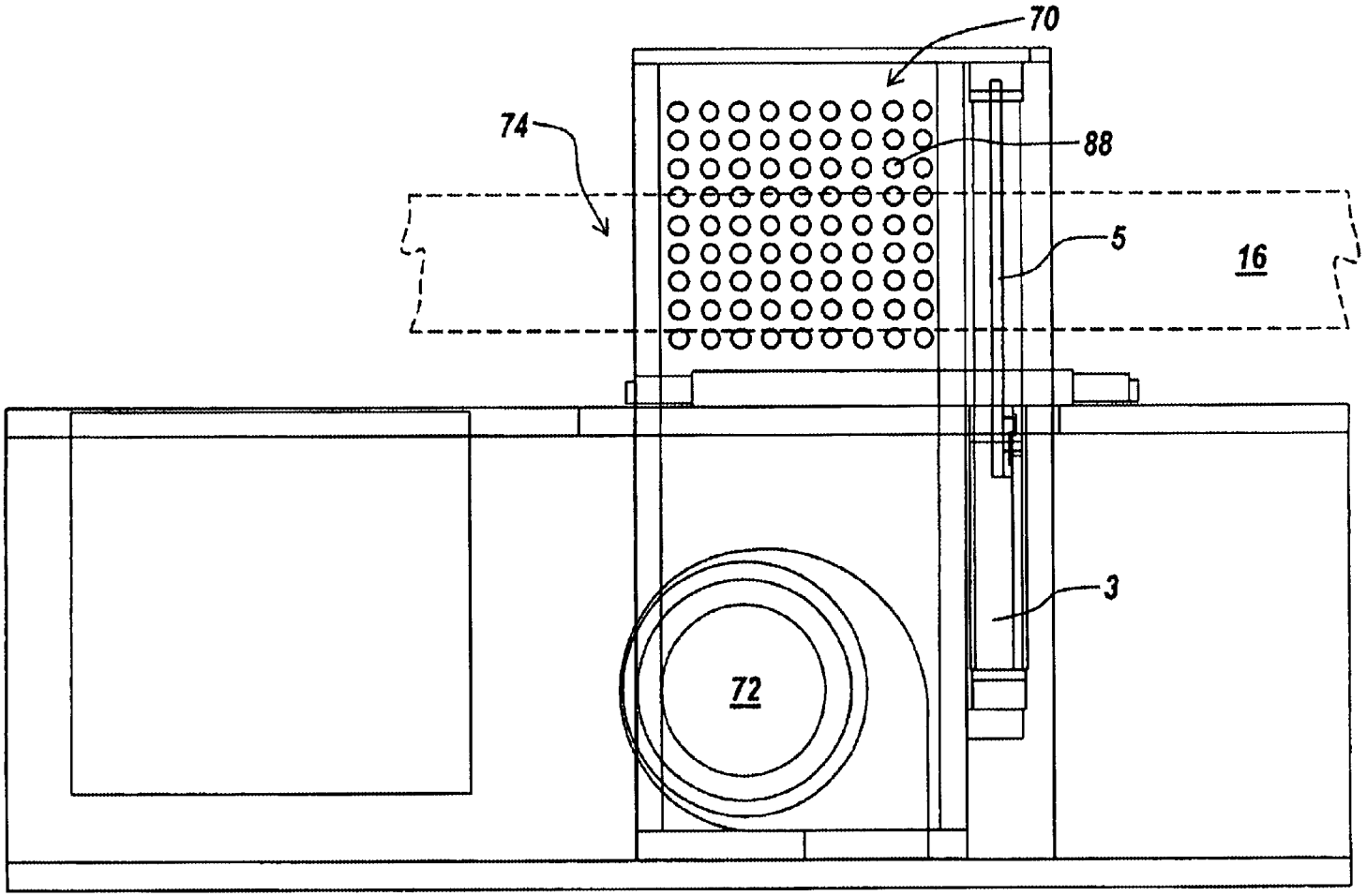
FIG. 11 is an enlarged sectional view of splice station shown in FIG. 2 along lines 11—11 showing a plan view of the upper splice plate shown adjacent the fan.

Referring to FIG. 11, setup and operation of the automatic label splicer 10 is as follows;

Controls: The OFF|ON switch is on the side of the control box, along with the speed control knob and the shift register counter. On the top is a large yellow reset button 34. A toggle switch to turn on or off the on board vacuum pump 59, and dual toggle switches to over speed the drive motor, and activate the splice operation.

1. OFF|ON switch—self-explanatory. (a red lamp indicates power is on)
2. Speed Control—should be set to keep the web loop nearly full all the time, but not so fast as to keep the motor turning on and off constantly. The photo eye in the loop box actually turns the motor on or off as needed to keep the loop "Full".
3. Shift Register Thumb Wheels and Splice Switches—these set the stop point for the splice to happen "In Register". The one time set up (per label length) can be done as follows: Remove or open door 64. Next load the web of labels 20 into the pull nip 62, being sure to thread the web through the slot scanner 32. Run the thumb roll to 0050, and momentarily move the toggle switch to "splice". The motor will go into creep speed, and the slot scanner will look for the division between labels. When the division is seen, the motor advances the number of steps on the shift counter then stops. (At this point lower splice plate would advance up if the air were on.)
4. The proper setting for the shift register is when the label stops with the label division centered on the cutter slot. To make the stop position change, you add counts to advance further before stopping or reduce counts to retard. Each time you change the shift register count, you must push the yellow reset button 34, and then repeat step 3 above to check the new stopping position. Repeat steps 3 & 4 until the proper stopping position is achieved.

The final switch is for the on board vacuum pump 59. This needs to be switched on when the splice is placed on the lower splice plate 14. The vacuum on vacuum pad 57 will hold the prepared splice in place until the lower splice plate 14 comes up to complete a splice.

The present invention typically is employed to handle pressure sensitive labels, but can also accommodate continuous label webs as well as continuous unprinted webs. Accordingly, for the purposes of this invention, the term web is any of but not limited to the following:

In the preferred embodiment labels shown in FIGS. 6A–D, labels, according to the present invention, are pressure sensitive labels comprising individual labels on a continuous carrier made of but not limited to paper or plastic film. Registration according to the present invention is accomplished by detecting the division between the labels or accomplished by detecting the divisions between the labels or any other means of monitoring a register position of the web.

In an alternate embodiment labels according to the present invention comprise a continuous label web. The web is not precut prior to loading in the label applicator, rather they are typically cut to length in a downstream labeling machine just prior to application to a selected container. In this embodiment, registration according to the present invention may be accomplished by detecting registration marks printed on the web, or alternatively looking at a particular graphic feature in the printed graphics on the web. Depending on the features of the label, other items can be selected for detection for registration purposes. The web/labels/materials may or may not be pressure sensitive material, for example labels used on some soda bottles, mouth wash, cans, etc.

In yet a further embodiment, labels according to of the present invention, comprise a continuous unprinted web. This web of its nature lacks marks to be detected for registration, hence registration is not required. Since the splice according to the present invention starts as soon as the end of the web is detected, the splice time is greatly reduced.

What is claimed is:

1. In a splicing apparatus having a dual unwind apparatus mounted on a frame, wherein said dual unwind apparatus comprises a turret rotatably mounted on the frame, wherein the improvement comprises:

a) the splicing apparatus comprises label splicing apparatus for preparing a trailing end of a depleted first running roll of labels and for splicing said depleted roll of labels to a fresh second standby roll of labels to provide continuous delivery of labels to a selected automatic labeling apparatus;

b) the labels are carried on a web formed in a roll;

c) the dual unwind apparatus comprises a first running roll of labels mounted on a web and a second standby roll of labels mounted on a web, wherein said turret is moveable between a first running position and second running position for alternately arranging the second standby roll of labels on top as a new running roll and arranging the first running roll on the bottom for replacement with a new roll;

d) the dual unwind apparatus comprises a central shaft having a reflector that only is visible at terminus of the web of a running roll;

e) sensing means comprising a photoelectric cell for detecting the central shaft of the turret when visible at terminus of the web of a running roll;

f) loop control means comprising drive apparatus arranged for unwinding the first running roll of labels and maintaining a constant loop of labels in a loop box in association with a loop sensing means comprising a output loop detector for monitoring and controlling the loop of labels size in said loop box;

g) the label splicing apparatus comprises a splicing station comprising;

i) a lower splice plate associated with indexing means moveable between a splice ready position and an upper splice position having a positioning means for holding a leading end of the web of said second standby roll of labels wherein said lower splice plate indexes up between a first position to a second compression position for pressing the web of said running roll and said standby web together;

ii) a cutter back plate pivotally mounted on the frame to swing between a first idle position and a second cut position for trapping the trailing end of a depleted first roll of labels;

iii) cutting means comprising a moveable blade for severing a trailing end of the depleted first running roll of labels at a point between adjacent labels, moveable between a cut position and a retracted position along a cutter slot; and iv) upper splice plate, fixedly mounted on a fan housing having upper positioning means comprising an air register for holding the trailing end of the depleted first running roll of labels in place awaiting splicing by means of compression by the lower splice plate pressing the web of said deplete first running roll of labels and the web of said second standby roll of labels; and h) registration apparatus for controlling splice sequence comprising;

i) a controller for regulating speed of said drive means comprising a variable speed motor associated with a rubber pull roll for putting said webs in registration; and ii) sensing means comprising a slot scanner for locating divisions between labels; whereby the web of said standby roll is held in a ready position for splicing end to end with the web of said running roll such that splicing rolls of labels is accomplished without reducing speed of labeling at rates of operation comparable to said selected automatic labeling equipment.

2. The label splicing apparatus of claim 1 wherein the registration apparatus comprises a shift register counter for regulating swinging said pivot plate between a first idle position to a second splicing position.

3. The label splicing apparatus of claim 1 wherein labels are pressure sensitive labels comprising individual labels on a continuous carrier made of but not limited to paper or plastic film wherein registration is accomplished by detecting divisions between the labels for monitoring a register position of the web.

4. The label splicing apparatus of claim 1 wherein the dual unwind means comprises:

a) a first running roll of labels mounted on a web with divisions between adjacent labels;

b) a second standby roll of labels mounted on a web with divisions between adjacent labels; and c) a turret apparatus rotatably moveable between a first running position for arranging the first running roll of labels on top and a second standby roll of labels on the bottom; and second running position for arranging the second standby roll of labels on top and the first running roll on the bottom; and a central shaft having a reflector that is only visible at terminus of the web of a running roll.

5. The label splicing apparatus of claim 1 wherein control of the drive means comprises a controller for regulating the speed of the drive means comprising a variable speed motor associated with a rubber pull nip for putting the webs in registration.

* * * * *